US007426364B2

(12) United States Patent
Kagawa et al.

(10) Patent No.: US 7,426,364 B2
(45) Date of Patent: Sep. 16, 2008

(54) FIXING METHOD, FIXING DEVICE, AND IMAGE FORMING APPARATUS

(75) Inventors: Toshiaki Kagawa, Kitakatsuragi-gun (JP); Hiroshi Kida, Yamatokoriyama (JP); Toyoaki Nanba, Higashiosaka (JP); Kouji Yamaji, Soraku-gun (JP); Tatsuya Shinkawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/011,369

(22) Filed: Dec. 15, 2004

(65) Prior Publication Data

US 2005/0135848 A1 Jun. 23, 2005

(30) Foreign Application Priority Data

Dec. 19, 2003 (JP) ..... 2003-423519

(51) Int. Cl.
*G03G 15/20* (2006.01)

(52) U.S. Cl. ..... 399/324; 399/328

(58) Field of Classification Search ..... 399/320, 399/324, 328

See application file for complete search history.

(56) References Cited

U.S. PATENT DOCUMENTS

| | | | | |
|---|---|---|---|---|
| 5,253,024 | A * | 10/1993 | Okuda et al. | 399/324 |
| 6,438,348 | B2 * | 8/2002 | Kobaru et al. | 399/333 |
| 2002/0051660 | A1 * | 5/2002 | Kobaru et al. | 399/320 |
| 2004/0184846 | A1 * | 9/2004 | Murata | 399/328 |

FOREIGN PATENT DOCUMENTS

| | | | |
|---|---|---|---|
| JP | 02-135482 | | 5/1990 |
| JP | 6-43776 | A | 2/1994 |
| JP | 08-202191 | | 8/1996 |
| JP | 9-237004 | A | 9/1997 |
| JP | 2734146 | B2 | 1/1998 |
| JP | 11282300 | A * | 10/1999 |
| JP | 11-305580 | A | 11/1999 |
| JP | 2000-019872 | | 1/2000 |
| JP | 2002-040842 | | 2/2002 |

OTHER PUBLICATIONS

Mitsuoka et al, "Development of High-Speed and Low-Energy Fusing System", Japan Hardcopy 2004 Fall Meeting, Published Nov. 26, 2004, pp. 29-32.

* cited by examiner

*Primary Examiner*—David M Gray
*Assistant Examiner*—Joseph S. Wong
(74) *Attorney, Agent, or Firm*—Nixon & Vanderhye P.C.

(57) ABSTRACT

A fixing device includes a fixing member in contact with an unfixed image constituted of developer T on one side of a recording material P; and a pressure member pressed against the fixing member. The fixing device fixes the unfixed image onto the recording material P by causing the recording material P, charged so as to have a same polarity as a polarity of the developer T, to pass through a gap between the fixing member and the pressure member. In the fixing device, an inflow current into the fixing member Ih is 0 when the recording material P passes through the gap between the fixing member and the pressure member. This securely restrains the developer on the recording material from electrostatically offset to the side of the fixing device, thereby maintaining the formation of high quality images.

7 Claims, 14 Drawing Sheets

FIXING METHOD, FIXING DEVICE, AND IMAGE FORMING APPARATUS

This Nonprovisional application claims priority under 35 U.S.C. § 119(a) on Patent Application No. 423519/2003 filed in Japan on Dec. 19, 2003, the entire contents of which are hereby incorporated by reference.

FIELD OF THE INVENTION

The present invention relates to a fixing method, a fixing device, and an image forming apparatus, which are used for an electrophotographic apparatus, such as a copying machine and a printer.

BACKGROUND OF THE INVENTION

A fixing device, a drying device, an erasing device, or a printing device of an electrophotographic image forming apparatus has a roller-shape or belt-shape fixing member and a roller-shape or belt-shape pressure members. The fixing member and the pressure member nip and carry a recording material having an unfixed image or a printed image, constituted of developer such as toner, which is formed thereon. The developer is melted and dried by heating so that the developer image is fixed onto the recording material.

For example, as shown in FIG. 3 describing the present embodiment, an electrophotographic image forming apparatus includes: a photoreceptive drum 22; an image forming section having various means provided around the drum; and a fixing section (fixing device 23) having a fixing device provided in downstream with respect to the image forming section in the flow of a recording material. In the image forming section, a toner image is formed on the photoreceptive drum 22 and transcribed onto the recording material. In the fixing section, the recording material is put into the nip section provided between a fixing member (fixing roller 231) and a pressure member (pressure roller 232) so that the toner image is heated and melted to be fixed onto the recording material while the recording material is being carried.

In the nip section, the fixing member and the pressure member are charged by (i) friction between the fixing member and the pressure device, and (ii) friction between the recording material and the fixing member, and (iii) friction between the recording material and the pressure member. An electrostatic effect which results from the charging causes a so-called offset phenomenon in which the toner adheres to the fixing member. When a large amount of toner adheres to the fixing member due to the electrostatic offset, this raises the following problems: after the fixing member has rotated 360°, the toner adheres again from the fixing member to the recording material to taint the output image side; or after the toner has accumulated as toner taint on a temperature sensor and a releasing nail, the toner adheres to the recording material under some conditions to taint the recording material.

Conventionally, in order to prevent the above electrostatic offset, as described in Japanese Patent Publication No. 2734146/1991 (Tokkyo 2734146; registered on Jan. 9, 1998) (Prior Art 1) for example, a bias voltage having the same polarity as the toner is applied to a fixing member to make the toner electrostatically repulsive so that toner taint caused by the electrostatic offset may be reduced. In addition, as described in Japanese Unexamined Patent Publication No. 305580/1999 (Tokukaihei 11-305580; published on Nov. 5, 1999) (Prior Art 2), a pressure member is made conductive and is grounded so as to restrain a fixing member and the pressure member from being charged so that toner taint caused by the electrostatic offset may be reduced.

However, as in Prior Art 1, when the bias voltage is applied to the fixing member, it is necessary that the pressure member is constituted of an insulating member or a high-resistance in order to prevent the bias voltage from leaking. Fluorine plastics are generally used to form a surface covering layer of the pressure member. A nonconductive fluorine plastic tube is negatively charged in terms of electrical properties. As shown in FIG. 16, the higher the fixing speed is, the higher the electrical potential is. For example, in the case of a high-speed machine whose printing speed is 50 sheets per minute or more (the fixing speed is 250 mm/s or higher), the electrical potential reaches as high as −3 to −5 kV. Meanwhile, a bias voltage of only up to about −2 kV can be applied to the fixing device due to the low pressure-resistant capacity of the coating layer (usually of fluorine plastics) of the fixing device. As a result, the Coulomb force toward the fixing member acts on the toner (usually negatively charged) on a recording material so that, as shown in FIG. 16, there still occurs electrostatic offset.

Moreover, for example, as is often the case with the contact point to the releasing nail, when the surface of the pressure member is partially damaged, impedance (surface resistance) of that part changes. As a result, the bias voltage applied to the fixing member undesirably leaks along that part, so that electrostatic offset corresponding to flaws on the surface of the pressure member occurs in a streak manner.

Meanwhile, as in Prior Art 2, when a pressure member is made conductive and is grounded, the pressure member is not be charged. This is effective in reducing the electrostatic offset of toner on the surface of a recording material. However, the toner adhering to the back of the recording material offsets to the pressure member. As a result, electricity removing means in contact with the pressure member becomes tainted over time with toner, paper dust, and the like. This lowers an electricity removing effect, so that the electrostatic offset occurs.

SUMMARY OF THE INVENTION

It is an object of the present invention to provide a fixing method, a fixing device, and an image forming apparatus which (i) securely suppress electrostatic offset under various use conditions, (ii) maintain normal image-forming operation, and (iii) ensure high image quality and a life of each means even in long-term use.

In order to achieve the above object, a fixing device according to the present invention includes: a fixing member (e.g., a fixing roller) in contact with an unfixed image constituted of developer (e.g., toner) on one side of a recording material (e.g., a recording sheet); and a pressure member (e.g., a pressure roller) pressed against the fixing member, the fixing device fixing the unfixed image onto the recording material by causing the recording material, charged so as to have a same polarity as a polarity of the developer, to pass through a gap between the fixing member and the pressure member, wherein when the recording material passes through the gap between the fixing member and the pressure member, an inflow current into the fixing member Ih is 0.

In addition, a fixing method according to the present invention includes the steps of: using a fixing member (e.g., a fixing roller), which is in contact with an unfixed image constituted of developer (e.g., toner) on one side of a recording material (e.g., a recording sheet), and a pressure member (e.g., a pressure roller), which is pressed against the fixing member; and causing the recording material, charged so as to have a same polarity as a polarity of the developer, to pass through a gap between the fixing member and the pressure member, so as to fix the unfixed image onto the recording material, wherein when the recording material passes through the gap between the fixing member and the pressure member, an inflow current into the fixing member Ih is 0.

According to the above arrangement, when a recording material is charged so as to have the same polarity as the developer, an electrostatic induction effect of the electrical charge retained in the recording material generates an electrical charge, having of the polarity adverse to that of the developer, in a vicinity of the surface of the fixing member. However, when the inflow current into the fixing member is 0, the electrical charge having the same polarity as the developer also remains in the fixing member, so that the polarity adverse to the charging polarity of the developer hardly causes the developer to be electrostatically absorbed by the fixing member. As a result, it is possible to prevent the electrostatic induction effect from causing the developer on the recording material to offset to the fixing member.

A fixing device according to the present invention includes: a fixing member in contact with an unfixed image constituted of developer on one side of a recording material; and a pressure member pressed against the fixing member, the fixing device fixing the unfixed image onto the recording material by causing the recording material, charged so as to have a same polarity as a polarity of the developer, to pass through a gap between the fixing member and the pressure member, wherein when the recording material passes through the gap between the fixing member and the pressure member, $Ih<Ip$ where an inflow current into the fixing member is Ih and an inflow current into the pressure roller is Ip.

A fixing method according to the present invention includes the steps of: using a fixing member, which is in contact with an unfixed image constituted of developer on one side of a recording material, and a pressure member, which is pressed against the fixing member; and causing the recording material, charged so as to have a same polarity as a polarity of the developer, to pass through a gap between the fixing member and the pressure member, so as to fix the unfixed image onto the recording material, wherein when the recording material passes through the gap between the fixing member and the pressure member, $Ih<Ip$ where an inflow current into the fixing member is Ih and an inflow current into the pressure roller is Ip.

According to the above arrangement, even in case the inflow current into a fixing member is generated, most of the electrical charge retained in a recording material moves to the pressure member side when the inflow current into a pressure member is higher than the inflow current into the fixing member. Thus, the fixing member does not become electrostatically inductive. As a result, the developer on the recording material can be prevented from offsetting to the fixing member.

A fixing device according to the present invention includes: a fixing member in contact with an unfixed image constituted of developer on one side of a recording material; and a pressure member pressed against the fixing member, the fixing device fixing the unfixed image onto the recording material by causing the recording material, charged so as to have a same polarity as a polarity of the developer, to pass through a gap between the fixing member and the pressure member, wherein the fixing member is electrically insulated from other members in contact with the fixing member.

According to the above arrangement, since a fixing member is insulated so as to be in a float state, the effect of electrostatic induction on the fixing member by the electrical charge retained in a recording material is so small that the developer can be prevented from offsetting to the fixing member. In addition, if the fixing member is in a float state, the effect of electrostatic induction of the fixing member is extremely small regardless of the electrical state (a ground state or a float state) of the pressure member. This eliminates the need to provide a grounding member such as a brush, a scraper, and the like on the pressure member side. As a result, the device can be simplified.

For a fuller understanding of the nature and advantages of the invention, reference should be made to the ensuing detailed description taken in conjunction with the accompanying drawings.

DESCRIPTION OF THE EMBODIMENTS

First Embodiment

One embodiment of the present invention will be described below according to the accompanying drawings.

Figure 2:
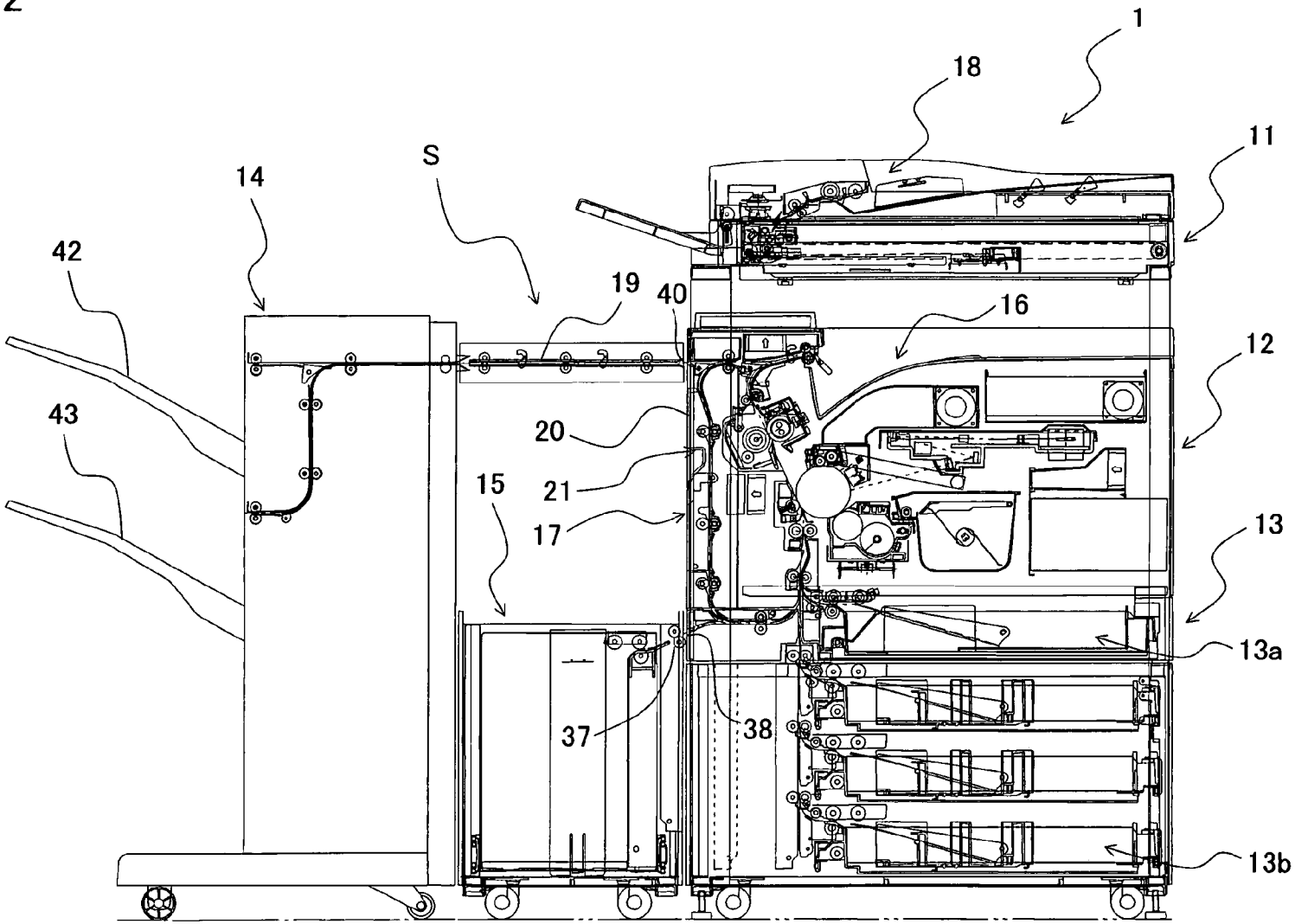
FIG. 2 is a longitudinal sectional view showing an arrangement of an image forming apparatus equipped with the fixing device shown in FIG. 1.

FIG. 2 is a longitudinal sectional view showing an arrangement of an image forming apparatus 1 to which a fixing device of the present invention is applied. The image forming apparatus 1 has a document-image reading device 11, an image recording device 12, a recording-material feeding device 13, a post-processing device 14, and an external recording-material feeding device 15.

The image recording device 12 serving as an image forming section, the recording-material feeding device 13 serving as a recording-material feeding section, and a carrier section 17 that carries recording materials from the recording-material feeding device 13 through the image recording device 12 to a recording-material delivery section 16 constitutes an image forming unit 20 such as a digital printer. The image forming unit 20 can be equipped with the document-image reading device 11, serving as an image reading device, so as to constitute a digital copying machine, a facsimile machine, and the like.

In the following, the operation of the image forming unit 20 will be described. First, the document-image reading device 11 reads a document to obtain image data and outputs the image data to the image recording device 12. The image recording device 12 processes the input image data suitably.

Delivered piece by piece from the recording-material feeding device 13 are sheet recording materials such as printer sheets and OHP (over head projector) sheets, which are then carried to the image recording device 12 through the first carrier route of the carrier section 17. The image recording device 12 forms images according to the image data on the recording materials by way of printing and the like. The recording materials with the images printed thereon are carried through the second carrier route of the carrier section 17 to the recording-material delivery section 16 and then are delivered out of the apparatus.

Connected to the document-image reading device 11 is a document tray 18 serving as a document feeding section or a document collection section. When the document tray 18 serves as a document feeding section, it can successively feed a series of multiple-page documents placed thereon piece by piece to a reading section. When the document tray 18 serves as a document collection section, it receives and retains the read documents that are successively delivered. In addition, in case of printing multiple copies of a series of read documents, the recording materials with the same page printed thereon are successively delivered to be mixed up so that a user must sort the recording materials after printing when the printed recording materials are delivered to the reading material delivery section 16. Accordingly, the post-processing device 14 is connected to the image forming unit 20 so that, for example, multiple copies may be delivered separately to a plurality of delivery trays so as not to be mixed up. In addition, the image forming unit 20 and the post-processing device 14 are installed at a predetermined distance from each other so as to leave a predetermined spaces therebetween. Furthermore, the image forming unit 20 and the post-processing device 14 are connected through an external carrier section 19 so that recording materials with images printed thereon are carried from the carrier section 17 through the external carrier section 19 to the post-processing device 14.

In addition, in view of energy saving and lower cost, recording materials such as print sheets are required to have images on both sides thereof. This can be realized by the double-side printing carrier device 21, which reverses a recording material subjected to a image printed on one side thereof and returns the recording material to the image recording device 12. The recording material with single-sided printing is carried neither to the recording-material delivery device 16 nor to the post-processing device 14, but is reversed in the double-side printing carrier device 21, and is returned to the image recording device 12. The image recording device 12 prints an image on the side having no image, thereby carrying out the printing.

Moreover, when there is a need to feed recording materials whose types and quantities are beyond the retaining capacity of the recording-material feeding device 13, the recording-material feeding device 15 can be connected as a function-expanding peripheral device to the image forming unit 20 so as to store and feed desired types or quantities of recording materials.

In the following, each of the devices and parts that constitute the image forming apparatus 1 will be described in detail.

Figure 3:
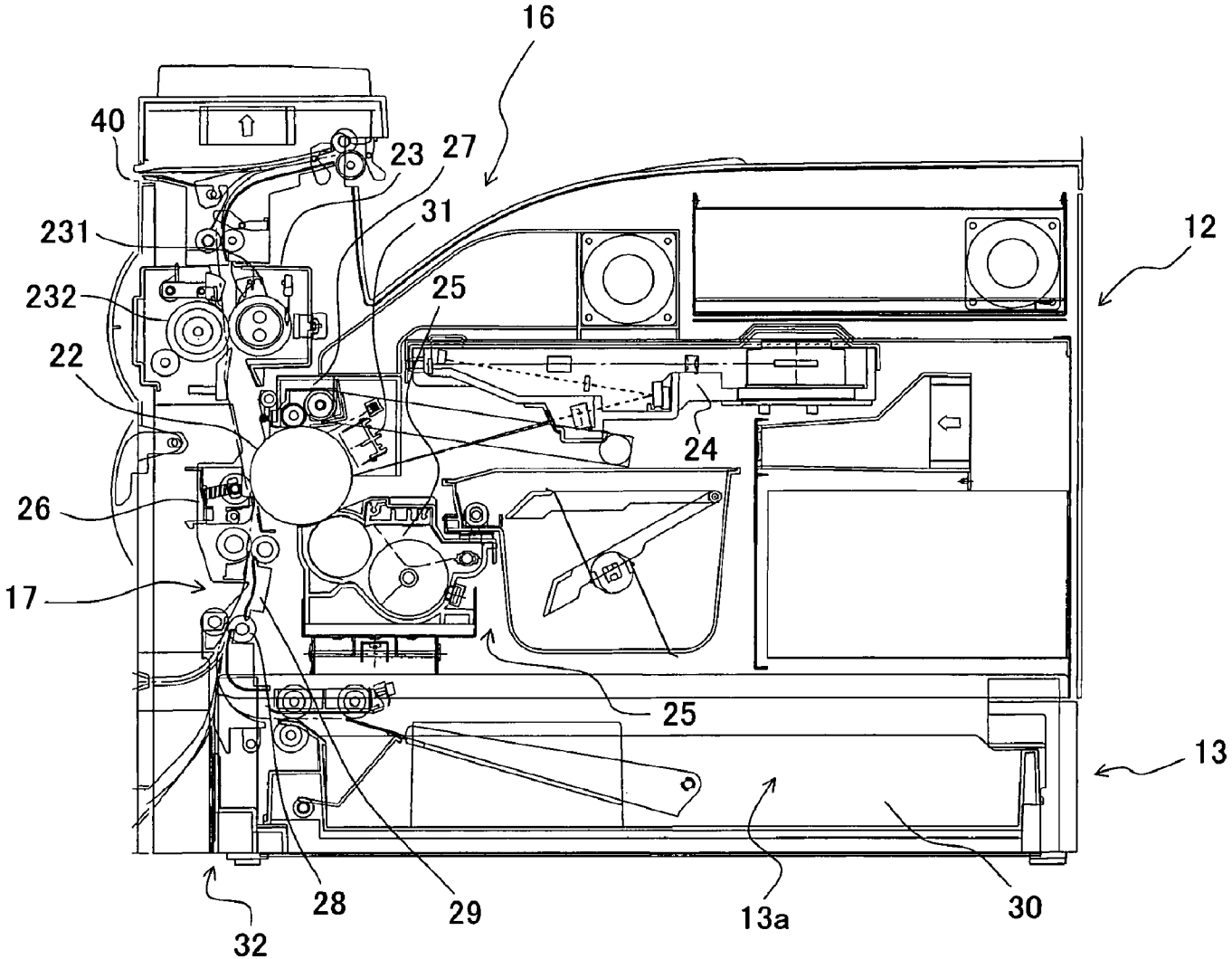
FIG. 3 is a longitudinal sectional view showing an arrangement of an image recording device included in the image forming apparatus shown in FIG. 2.

FIG. 3 is a longitudinal sectional view showing an arrangement of the image recording device 12. Disposed on the substantially left-of-center side of the image recording device 12 is an electrophotographic processing section constituted mainly of a photoreceptive drum 22. Sequentially disposed around the photoreceptive drum 22 are: an charging unit 31, which uniformly charges the surface of the photoreceptive drum 22; a light scanning unit 24, which scans a light image so as to write an electrostatic latent image onto the photoreceptive drum 22 so uniformly charged; a developing unit 25, which uses developer so as to develop the electrostatic latent image written by the light scanning unit 24; a transcription unit 26, which transcribes the image, recorded and developed on the surface of the photoreceptive drum 22, onto recording materials; a cleaning unit 27, which removes the developer remaining on the surface of the photoreceptive drum 22 so as to enable the photoreceptive drum 22 to record a new image; and the like. Furthermore, according to the present embodiment, a contact transcription mode using a transcription belt is applied to the transcription unit 26.

Disposed above the electrophotographic processing section is a fixing device 23, which sequentially receives recording materials with images transcribed thereonto by the transcription unit 26 so as to heat and fix the developer transcribed onto the recording materials. The recording materials with the images printed thereon are delivered, with the print side facing down (face down), from the recording-material delivery section 16 positioned in the upper part of the image recording device 12. Furthermore, the residual developer removed by the cleaning unit 27 is recovered and returned for reuse to a developer feeding section 25*a* of the developing unit 25.

Disposed in the lower part of the image recording device 12 is a recording-material feeding section 13*a* for storing recording materials, which feeds recording materials piece by piece to the electrophotographic processing section. The carrier section 17 is constituted of a plurality of rollers 28 and guides 29. Recording materials are carried from the recording-material feeding section 13*a* through the first carrier route defined between the rollers, between the guides, between the photoreceptive drum 22 and the transcription unit 26, and the like. After images are printed, the recording materials are further carried through a second route defined between the rollers, between the guides, between the fixing devices 23, and the like so as to be delivered to the recording-material delivery section 16. Furthermore, when recording materials are placed in the recording-material feeding section 13*a* for replenishment or replacement, a recording-material storing tray 30 is drawn out crossing the carrier direction of the image recording device 12 at right angles, that is, in FIG. 3, in a front direction perpendicular to the page face.

In addition, provided beneath the image recording device 12 is a recording-material receiving section 32 for receiving and then sequentially feeding recording materials carried from a recording-material feeding device 13*b* (expansion unit) into a gap between the photoreceptive drum 22 and the transcription unit 26.

Moreover, disposed in the space around the light scanning unit 24 are a process control unit (PCU) board, which controls the electrophotographic processing section; an interface board, which receives image data from outside of the apparatus; an image control unit (ICU) board, which predeterminedly processes image data received from the interface board and image data read by the document-image reading device 11 and then makes the light scanning unit scan and record the image data as images; a power supply unit, which supplies electricity to the above various boards and units; and the like.

Furthermore, the image recording device 12 can be connected by itself to external devices, such as personal computers, through the interface board in order to serve as a printer for forming images, based on the image data from the external devices, on recording materials. In addition, although one recording-material feeding section 13*a* is installed in the image recording device 12 according to the above description, two or more recording-material feeding sections can be installed in the device.

Figure 4:
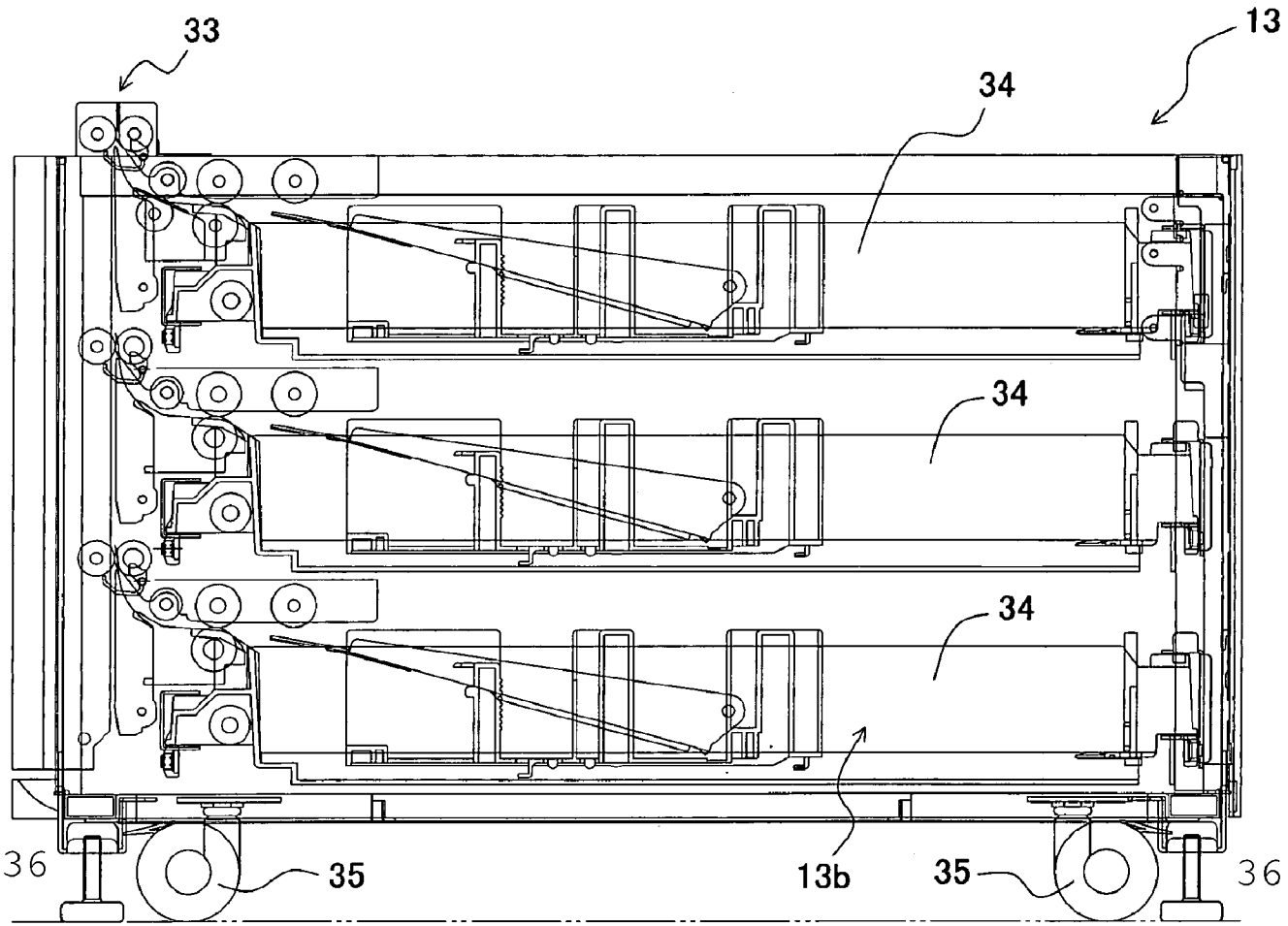
FIG. 4 is a longitudinal sectional view showing an arrangement of a recording-material feeding device installed in the image forming apparatus shown in FIG. 2.

FIG. 4 is a longitudinal sectional view showing an arrangement of the recording-material feeding section 13*b* (expansion unit). The recording-material feeding section 13*b* can be added as a part of the image recording device 12 in such cases as when the recording-material feeding section 13*a* cannot store a sufficient quantity of recording materials. The recording-material feeding section 13*b* can store larger recording materials than recording materials which can be stored in the recording-material feeding section 13*a*. The recording-material feeding section 13*b* delivers recording materials piece by piece to a recording-material delivery section 33 provided on the upper surface thereof.

Three recording-material storage trays 34 are stacked. Out of the stacked recording-material storage trays 34, a recording-material storage tray that stores desired recording materials is selectively operated under the control of the PCU and the like so as to separate and carry each recording material stored therein. Thus, carried recording material reaches the electrophotographic processing section from the recording-material delivery section 33 through the recording-material receiving section 32 provided beneath the image recording device 12.

It is to be noted that, in case of placing recording materials in the recording-material feeding section 13*b*, the recording-material storage tray 34 is drawn out to the front from the recording-material feeding section 13*b* so as to replenish or replace recording materials. In addition, although three recording-material housing trays are stacked according to the above description, at least one recording-material storage tray or three or more recording-material storage trays and recording-material delivery sections can be employed.

Provided beneath the recording-material feeding device 13*b* are a plurality of wheels 35 so as to make it easy to move the image forming unit 20 including the recording-material feeding device 13*b* for additional installation and the like. Further, it is also possible to fix the image forming unit 20 at an installation position by using a stopper 36.

Figure 5:
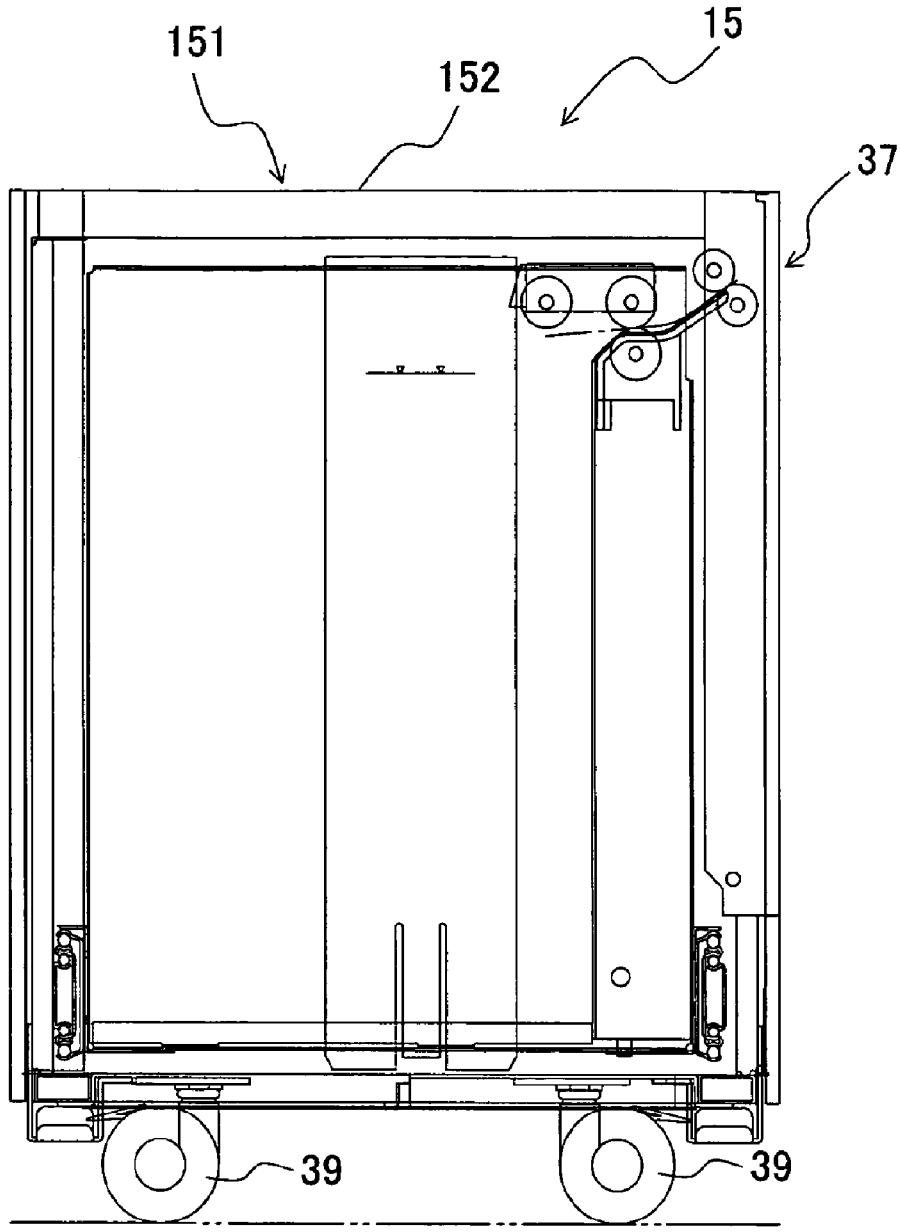
FIG. 5 is a longitudinal sectional view showing an arrangement of an external recording-material feeding device installed in the image forming apparatus shown in FIG. 2.

FIG. 5 is a cross-sectional view showing an arrangement of the external recording-material feeding device 15. The external recording-material feeding device 15 can store recording materials whose types and quantities are beyond the retaining capacity of the recording-material feeding devices 13*a* and 13*b* installed in the image recording device 12, and carries the stored recording materials piece by piece to a recording-material delivery section 37 provided on an upper part of the right side of the apparatus. The recording materials delivered from the recording-material delivery section 37 are delivered to an external recording-material receiving section 38 (see FIG. 2) provided on a lower part of the left side of the image recording device 12.

In case of placing recording materials in the external recording-material feeding device 15, recording materials are replenished and replaced through a replenishing port 151 provided in the upper part of the external recording-material feeding device 15. In addition, the replenishing port 151 is provided with a lid 152, being openable and closable, which may be closed except in such cases as replenishment or replacement.

Furthermore, provided beneath the external recording-material feeding device 15 are a plurality of wheels 39 so as to make it easy to move the external recording-material feeding device 15 for additional installation and the like. In addition, the wheels are provided with stoppers so as to fix the external recording-material feeding device 15 in an installation position.

Figure 6:
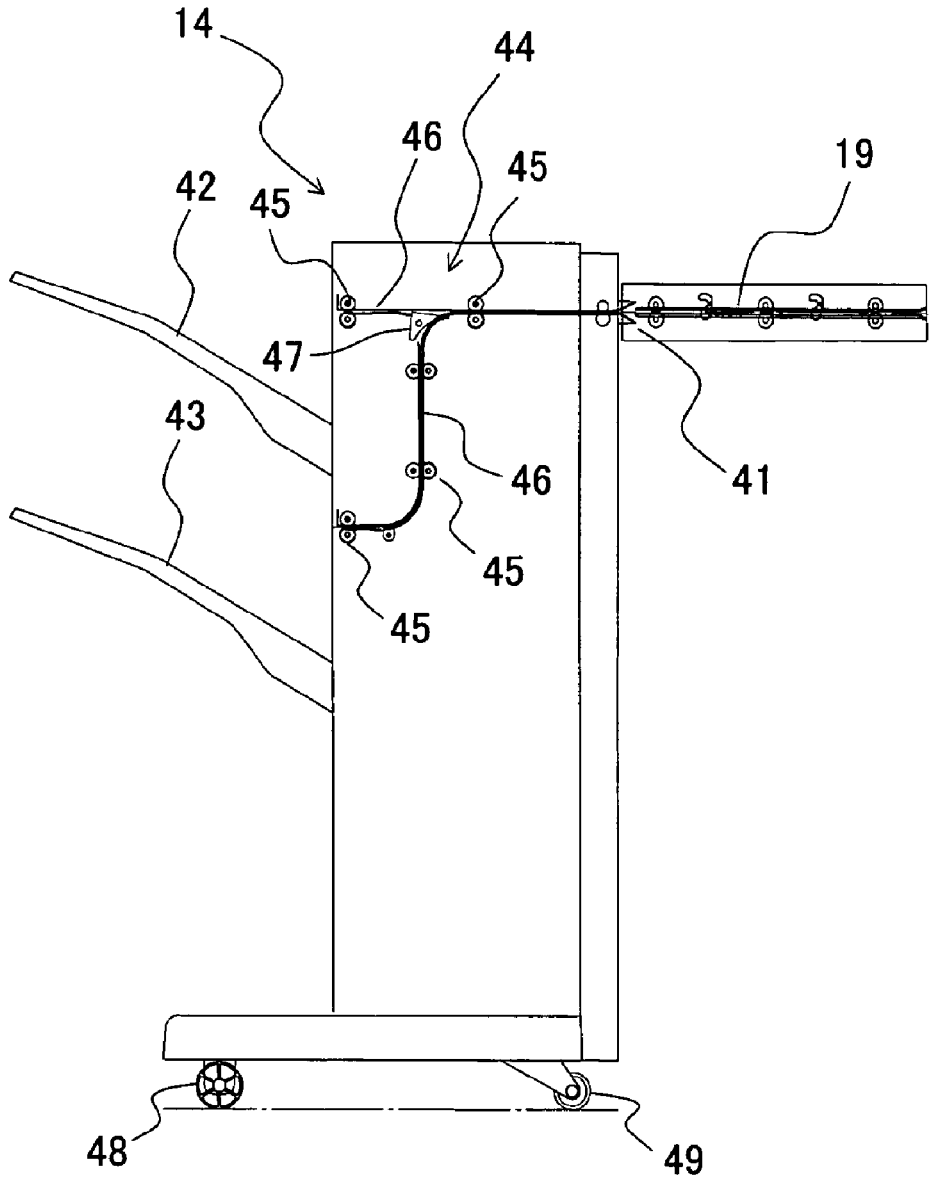
FIG. 6 is a longitudinal sectional view showing an arrangement of a post-processing device installed in the image forming apparatus shown in FIG. 2.

FIG. 6 is a cross-sectional view showing an arrangement of the post-processing device 14. The post-processing device 14 is installed at a predetermined distance from the image forming unit 20. The post-processing device 14 and the image forming unit 20 are connected through the external carrier section 19, through which a recording material with an image printed thereon by the image forming unit 20 is carried to the post-processing device 14. One end of the external carrier section 19 is connected to an external delivery section 40 of the image recording device 12; the other end is connected to a recording-material receiving section 41 of the post-processing device 14.

The post-processing device 14 has a sorting carrier section 44 that can selectively deliver carried recording materials to a delivery tray 42 or 43. The sorting carrier section 44 is constituted of a plurality of rollers 45, guides 46, and a direction-switching guide 47. The direction-switching guide 47 can be controlled to switch delivery destinations. Users can select the delivery tray 42 or 43 as a delivery destination so as to sort and then deliver recording materials with images thereon.

In addition to the sorting process mentioned above, there are such post-processing steps as described herein. A predetermined quantity of recording materials can be stapled. Printer sheets of B4, A4, and the like can be folded. Recording materials can be provided with holes therethrough for filing.

Furthermore, the undersurface of the post-processing device 14 is provided with wheels 48 and 49 for easy carrying. In addition, the post-processing device 14 is provided with the external carrier section 19. The external carrier section 19 and the image recording device 12 may be detachably configured. The external carrier section 19, the post-processing device 14, and the image forming unit 20 may be detachably configured.

Figure 7:
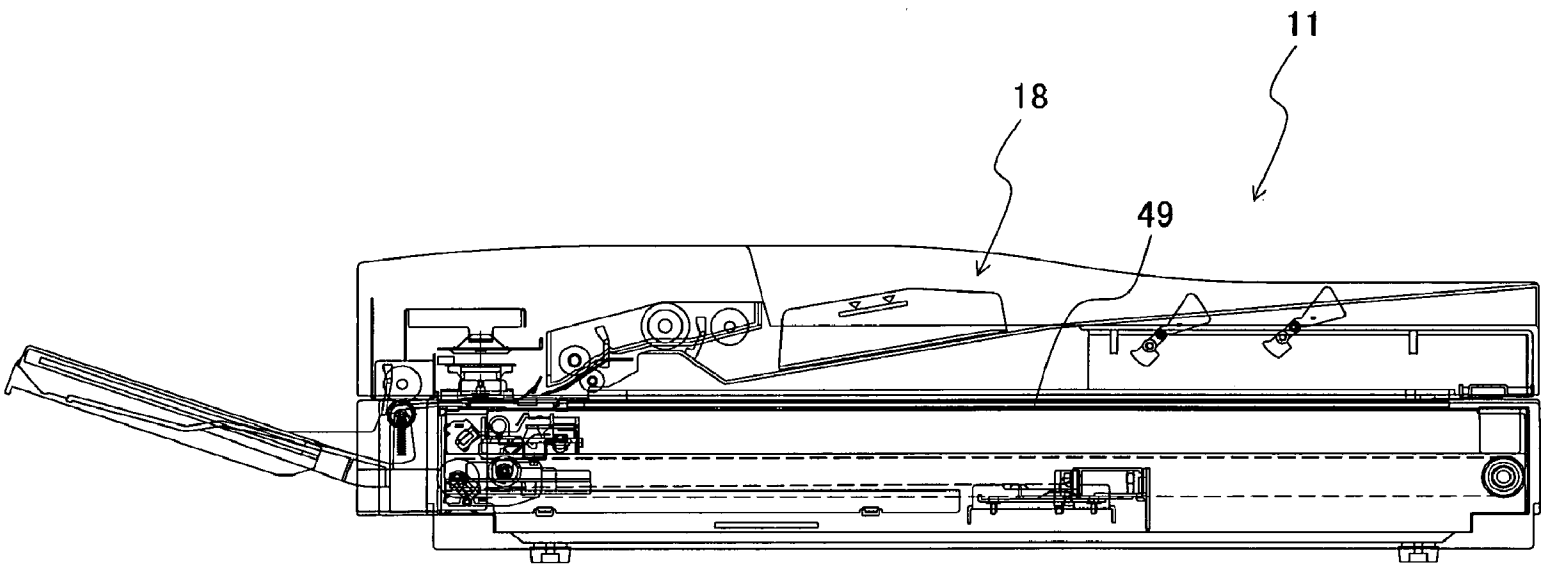
FIG. 7 is a longitudinal sectional view showing an arrangement of a document-image reading device installed in the image forming apparatus shown in FIG. 2.

FIG. 7 is a cross-sectional view showing an arrangement of the document-image reading device 11. The document-image reading device 11 can be operated in two modes: an automatic read mode, in which an automatic document feeding device (ADF) automatically feeds sheet documents so as to expose, scan, and then read each sheet document; and a manual read mode, in which book documents or sheet documents that cannot be fed automatically by the ADF are manually set and read. The image of a document placed automatically or manually on a document read stage 49 (a transparent read station) is exposed and scanned to form an image on a photoelectronic conversion element and then converted to an electrical signal for image data. Thus obtained image data is output through a connection part to the image recording device 12.

In addition, in case of reading a double-side document, document images can be scanned and read simultaneously from both sides of the documents in the process of carrying the document along a document carrier route. In addition, the undersurface of the document is read by a movable scanning exposure optical apparatus stopped in a predetermined position to lead a light image to a CCD. In addition, the top surface of the document is read by a contact image sensor (CIS) constituted integratedly of a light source, which, located above the document carrier route, which exposes documents; an optical lens, which leads the light image to a photoelectronic conversion element; a photoelectronic conversion element, which converts the light image to image data; and the like. When double-side reading is chosen, the documents set in the document feeding section are sequentially carried so that the images on both sides are read substantially simultaneously.

The document-image reading device 11 is provided with the document tray 18 used to feed a document which has not been read or to receive a document which has been read. When the document tray 18 is used to feed a document, a drawing section of the ADF draws the document, placed in the document tray 18, which has not been read, and carries the document to the document read stage 49. The document which has been read is delivered out of the apparatus by the document delivery section. When the document tray 18 is used to receive a document, the drawing section of the ADF draws the document, placed in the document tray 18 serving also as a document feeding section, and carries the document to the document read stage 49. The document which has been read is delivered to the document tray 18 by the document delivery section.

Figure 8:
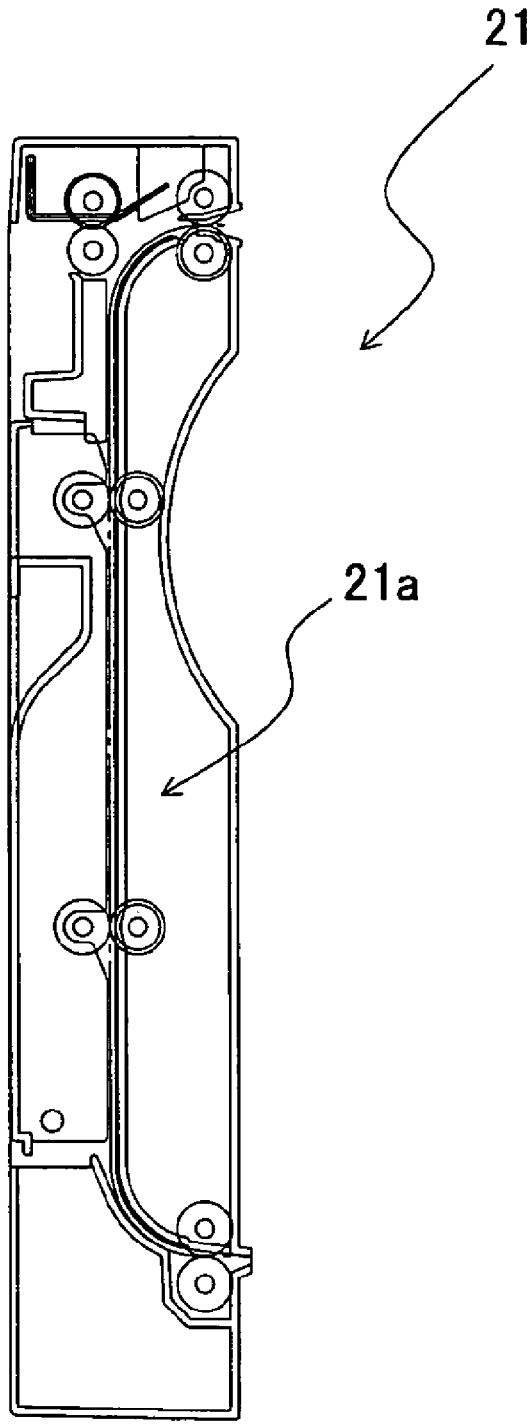
FIG. 8 is a longitudinal sectional view showing an arrangement of a double-side printing carrier device installed in the image forming apparatus shown in FIG. 2.

FIG. 8 is a longitudinal sectional view showing an arrangement of the double-side printing carrier device 21, which, having a double-side printing carrier section 21*a*, which is installed on the image reading device 12 shown in FIG. 3 so as to be positioned on the side of the external delivery section 40. The double-side printing carrier device 21*a* switchback carries recording materials delivered from the fixing device 23, in a switchback manner, by using the delivery section 16 positioned in the upper part of the image recording device. That is, the double-side printing carrier device 21*a* reverses recording materials to feed them again into a gap between the photoreceptive drum 22 of the electrophotographic processing section of the image recording device 12 and the transcription unit 26. In the image recording device 12, recording materials which have been printed are carried into the carrier route, in which recoding materials are delivered toward the delivery section 16 in the upper part of the apparatus, in a switchback manner, so that the recording materials can be led to the post-processing device 14 shown in FIG. 6 and the double-side printing carrier section 21*a*.

In the following, an arrangement of the fixing device 23 will be described in detail according to FIGS. 1, 9 and 10.

Figure 1:
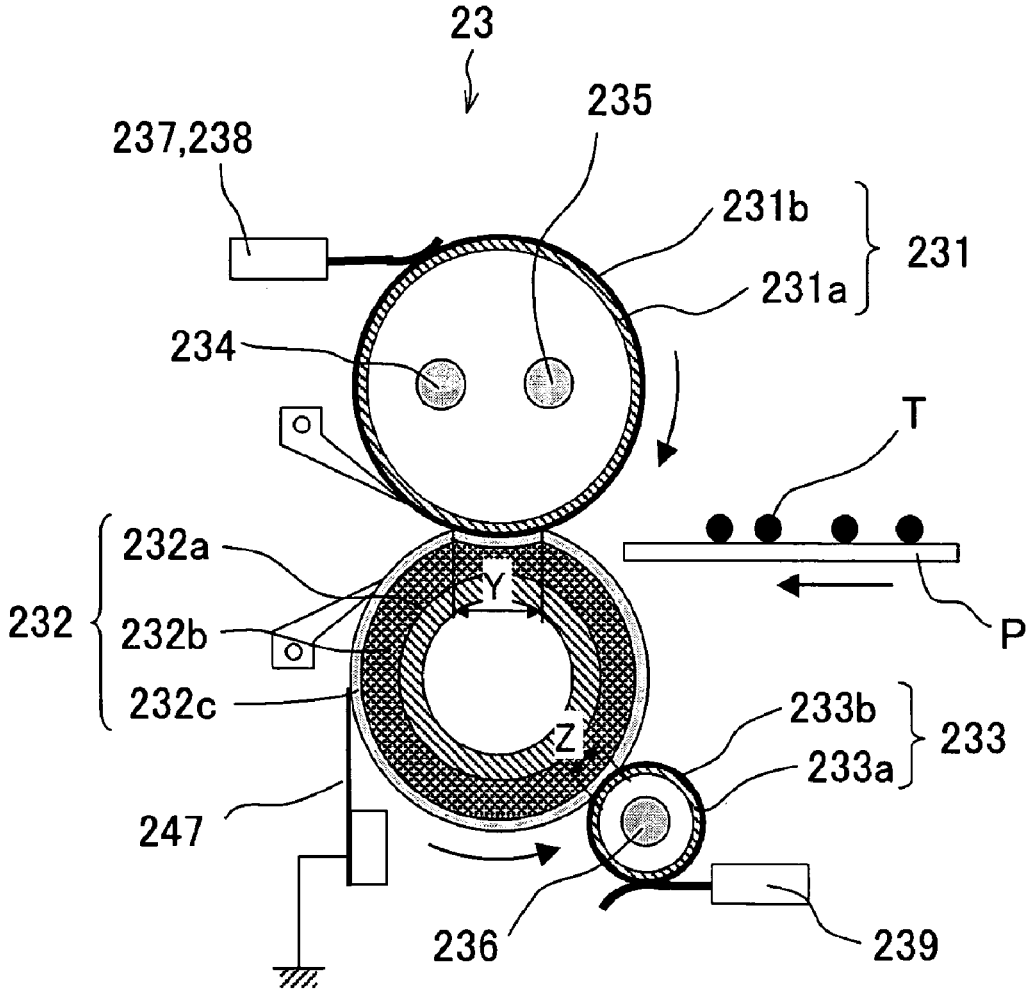
FIG. 1 is a longitudinal sectional view showing a fixing device according to one embodiment of the present invention.

As shown in FIG. 1, the fixing device 23 is provided with a fixing 231 serving as a fixing member; a pressure roller 232 serving as a lower pressure member; an external heating roller 233 serving as external heating means; heater lamps 234, 235, and 236 serving as heat sources for the fixing roller and the external heating roller; temperature sensors 237, 238, and 239 constituting temperature detection means for detecting the temperatures of the fixing roller 231 and the external heating roller 233; a cleaning member 247; a control circuit (not shown) serving as temperature controlling means.

The heater lamps 234, 235, and 236 are halogen heaters and are disposed inside of the fixing roller 231 and the external heating roller 233. The heater lamps 234, 235, and 236 are charged by the control circuit to emit light in a predetermined heating distribution and radiate infrared rays so that the inner surfaces of the fixing roller 231 and the external heating roller 233 are heated.

The fixing roller 231 is heated by the heater lamps 234 and 235 to a predetermined temperature (200° C. in this description) in order to heat a recording sheet P with a toner image T unfixed thereon that is about to pass through a fixing nip of the fixing device 23. The fixing roller 231 is provided with a plug 231*a* serving as a body thereof and a mold releasing layer 231*b* formed on the outer surface of the plug 231*a* to prevent the toner T on the recording sheet P from offsetting.

The plug 231*a* is constituted, for example, of metals such as iron, stainless steel, aluminum, and copper, or alloys thereof. Furthermore, the plug 231*a* according to the present embodiment is an iron (STKM) plug that has a diameter of 40 mm and a thickness of 1.3 mm for lower heat capacity.

The mold releasing layer 231*b* is suitably constituted of fluorine plastics such as PFA (a coplymer of tetrafluoroethylene and perfluoroalkylvinylether), PTFE (polytetrafluoroethylene), and the like; silicone rubber; and fluorine rubber. Furthermore, the mold releasing layer 231*b* according to the present embodiment is a blend of PFA and PTFE painted and calcinated so as to have a thickness of 25 μm.

Figure 9:
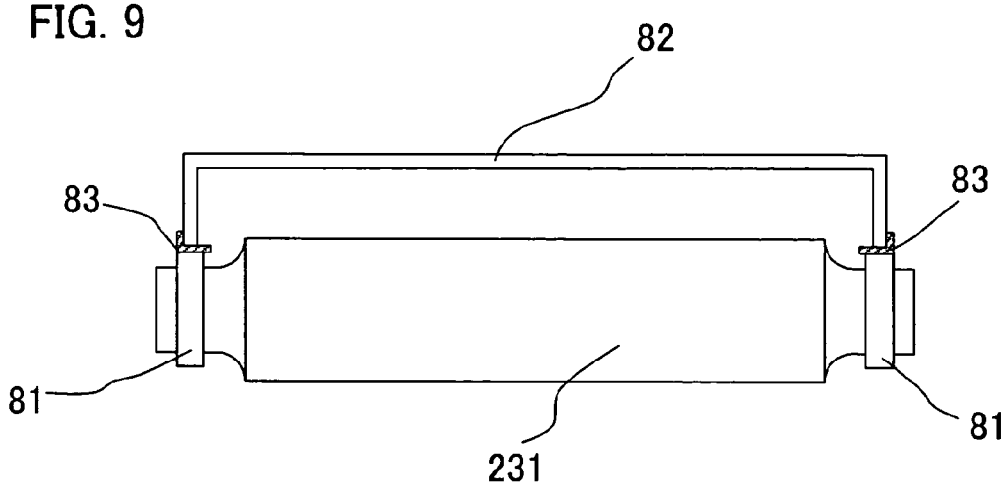
FIG. 9 is a front view showing a supporting structure of a fixing roller shown in FIG. 1.
Figure 10:
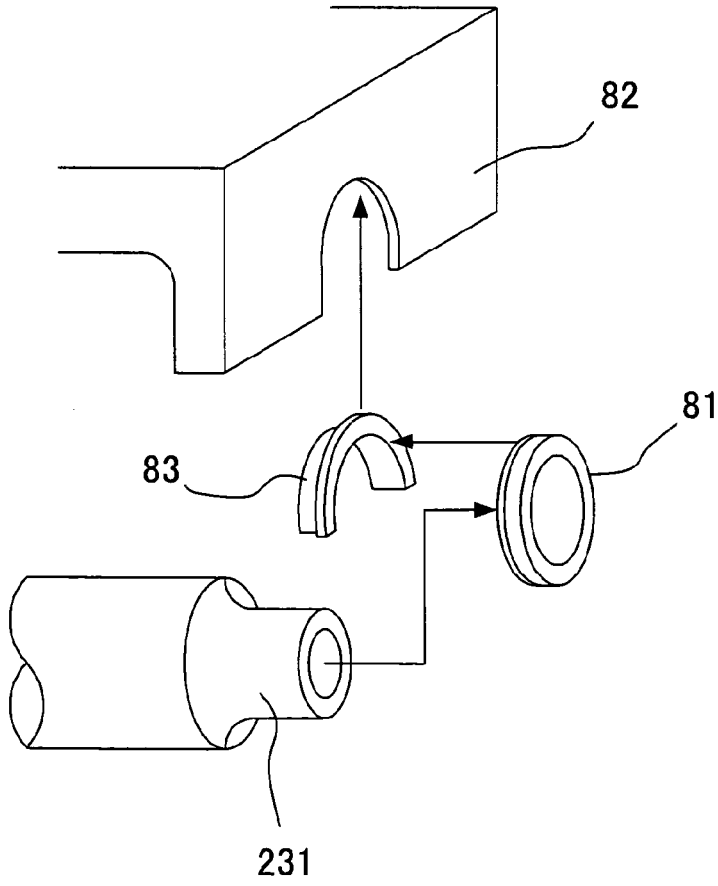
FIG. 10 is an exploded perspective view showing the supporting structure of the fixing roller shown in FIG. 1.
Figure 11:
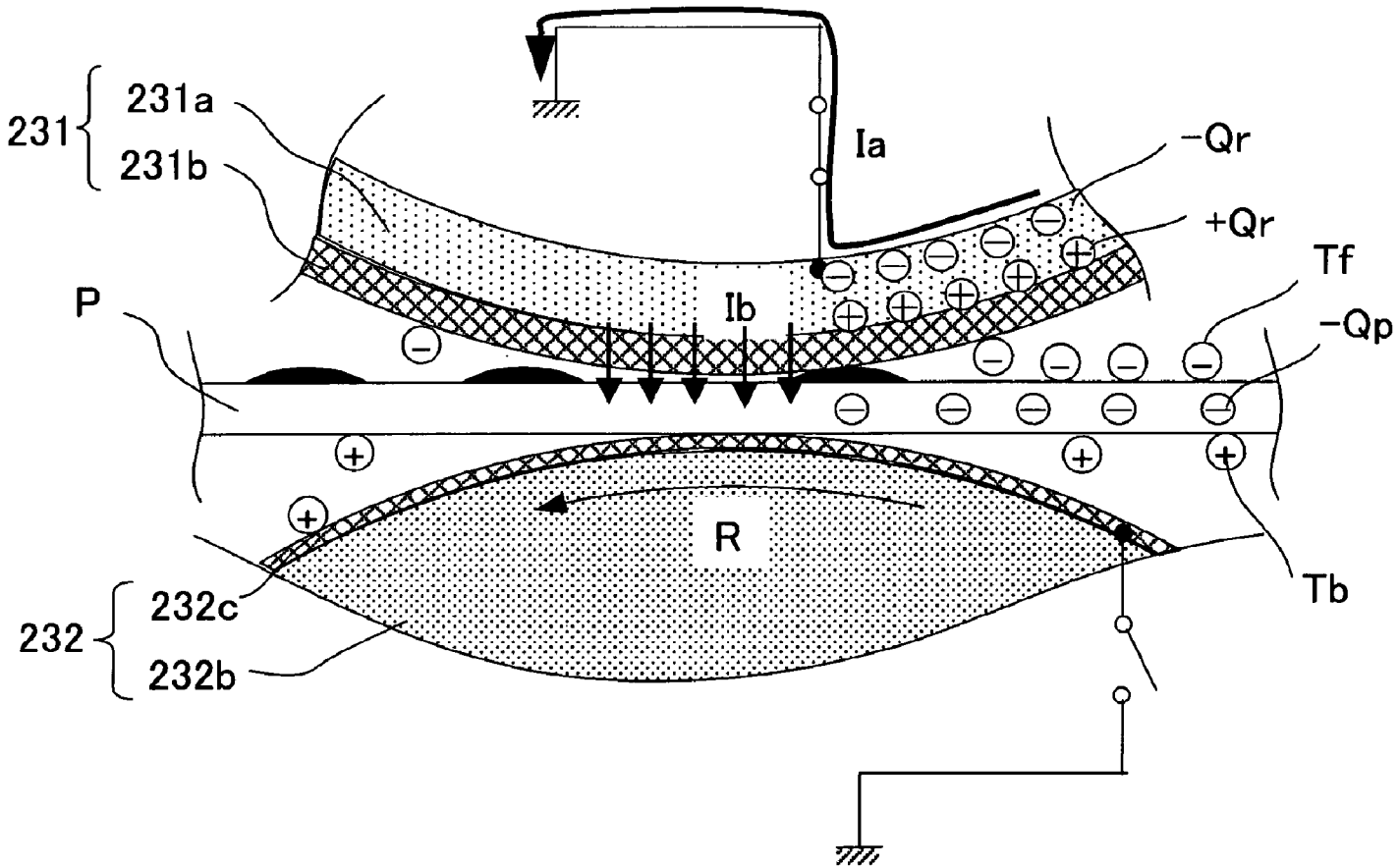
FIG. 11 is an explanatory drawing of electrostatic offset according to one comparative example compared with examples of the fixing device of the present invention.
Figure 12:
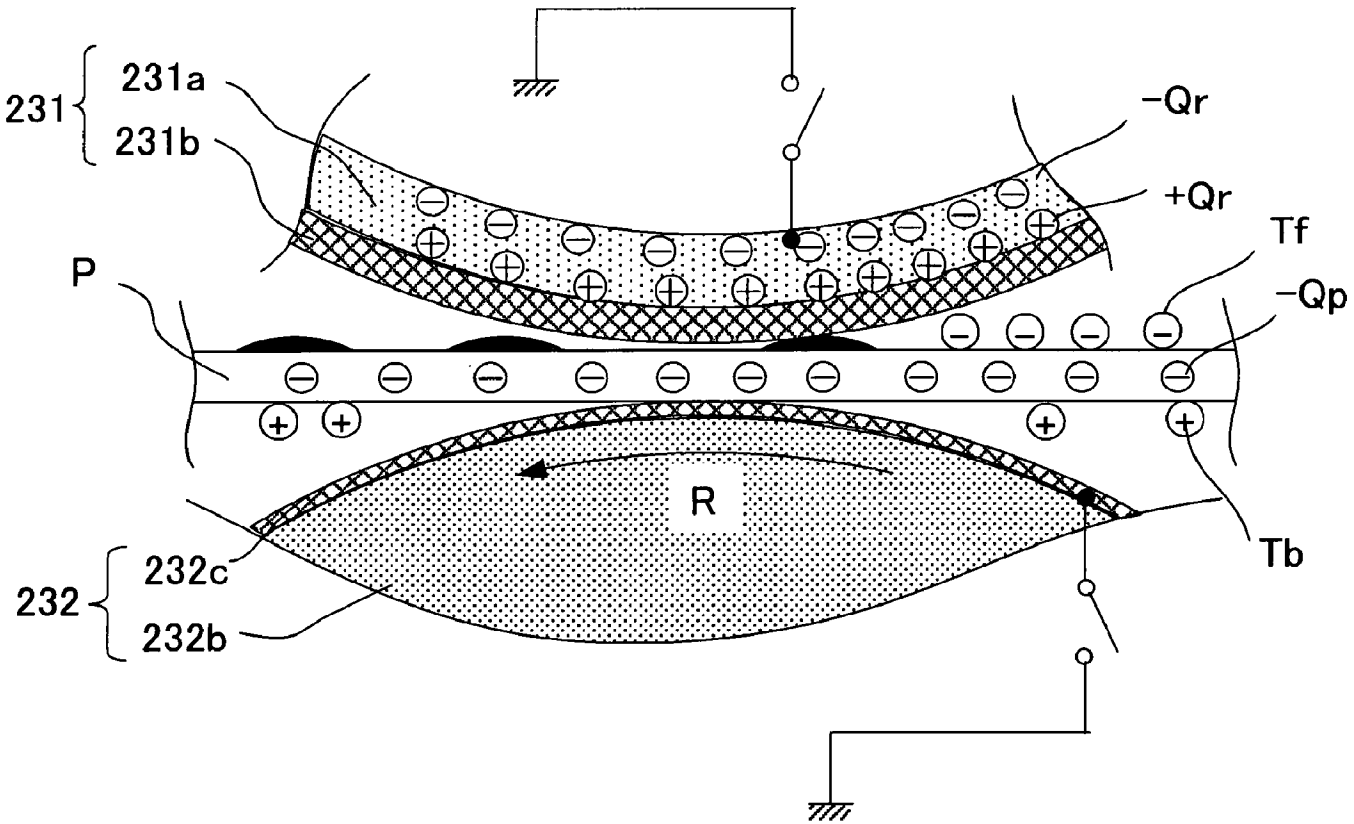
FIG. 12 is an explanatory drawing of electrostatic offset in one example of the fixing device of the present invention.
Figure 13:
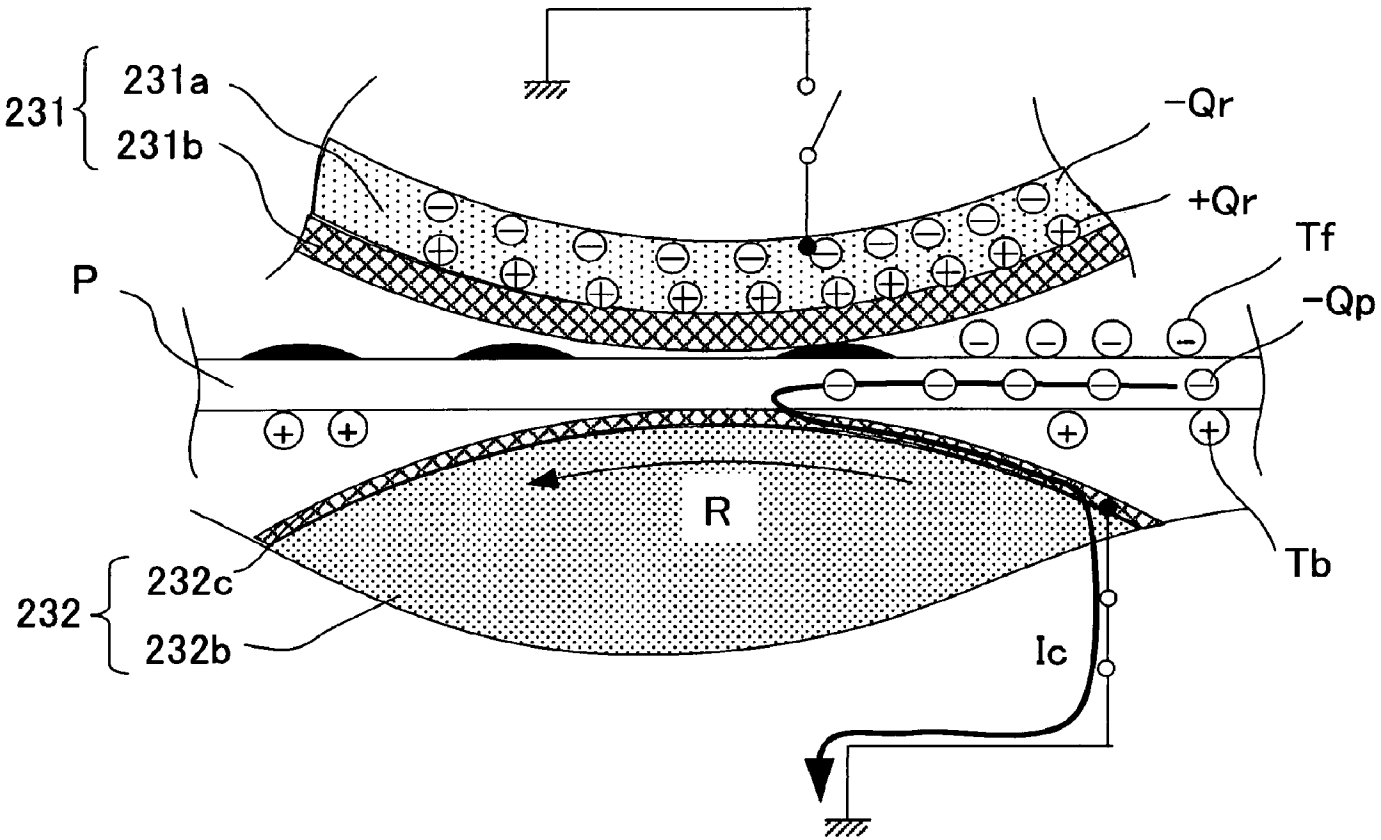
FIG. 13 is an explanatory drawing of electrostatic offset according to another example of the fixing device of the present invention.
Figure 14:
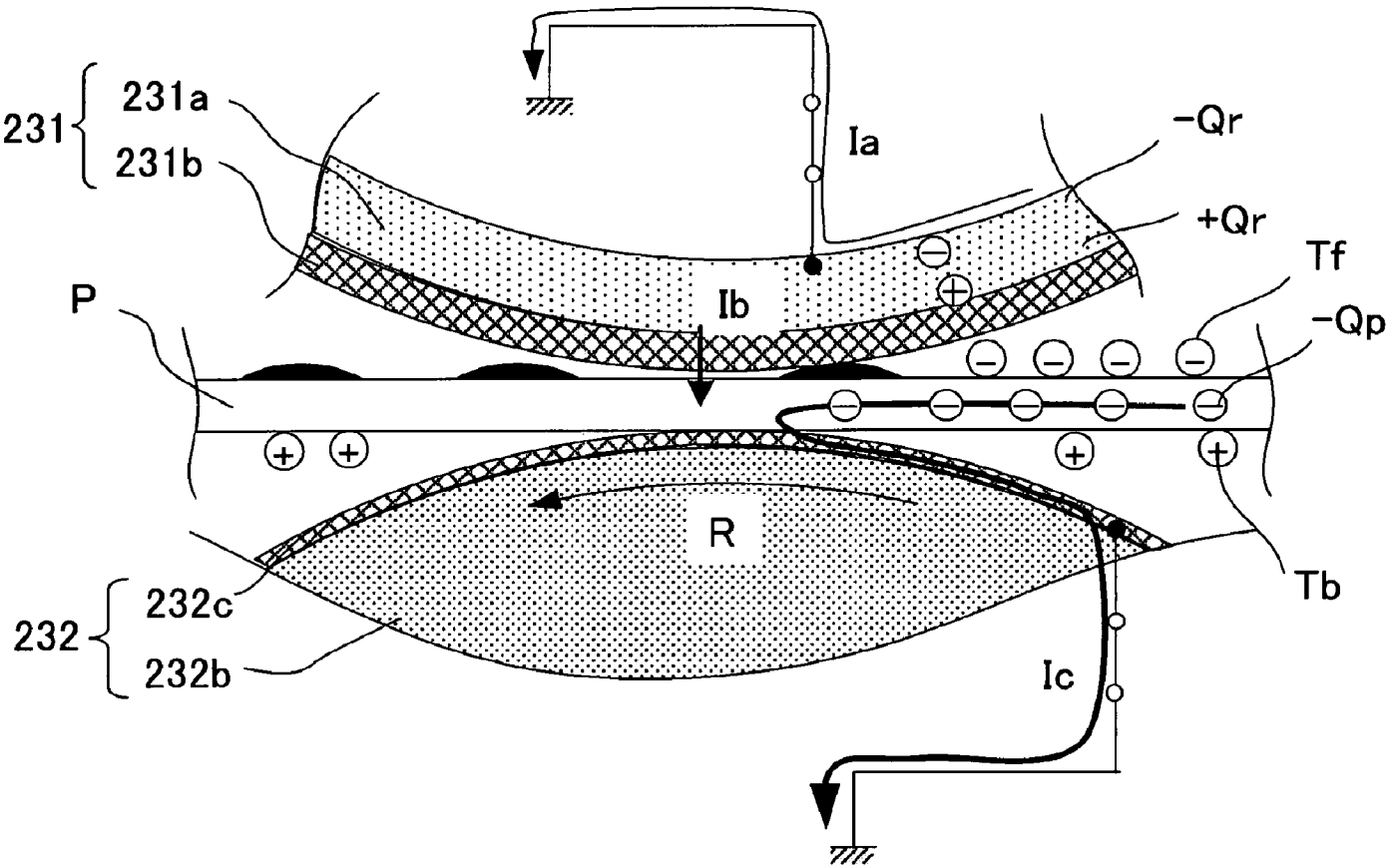
FIG. 14 is an explanatory drawing of electrostatic offset according to still another example of the fixing device of the present invention.

FIG. 9 is a front view, and FIG. 10 is an exploded perspective view, both of which show the supporting structure of the fixing roller 231. As shown in FIGS. 9 and 10, the fixing roller 231 is supported by each of ball bearings 81 attached to a frame 82 of the fixing device 23. The frame 82 is a press-molded iron cold rolled steel. The ball bearing 81, having an outer rim, a rolling element, and an inner rim, is fitted to the journals of the draw parts at both ends of the fixing roller 231.

As shown in FIGS. 9 and 10, the ball bearing 81 fitted to the fixing roller 231 and the frame 82 has bearing holders 83 therebetween for insulation to support load. The bearing holder 83 is made of heat-resistant and insulating materials such as PPS resin (polyphenylene sulfide) and PPO resin (polyphenylene oxide). The bearing holder 83 electrically insulates the fixing roller 231 from the frame of the image forming apparatus 1 and the frame 82 of the fixing device 23.

The pressure roller 232 is so arranged as to have a heat-resistant flexible layer 232*b*, made of silicone rubber and the like, on the outer surface of a plug 232*a*, made of steel, stainless steel, aluminum, and the like. As is the case with the fixing roller 231, a mold releasing layer 232*c* of fluorine plastics may be formed on the surface of the heat-resistant flexible layer 232*b* of the pressure roller 232. Furthermore, a pressure roller 232 according to the present embodiment includes a plug 232*a* of stainless steel with a diameter of 40 mm. Provided on the plug 232*a* is a heat-resistant flexible layer 232*b* of silicone rubber (rubber hardness JIS-A 31°) with a thickness of 6 mm. Provided further on the surface of the heat-resistant flexible layer 232*b* is a mold releasing layer 232*c* of a PFA tube with a thickness of 70 μm. The pressure roller 232 arranged in this manner is pressed against the fixing roller 231 with a force of 76 kgf (745 N) by pressure means (not shown), such as springs, so that a fixing nip Y with a width of 6 mm may be formed between the fixing roller and the pressure roller.

Furthermore, a conductive PFA tube containing a conductive agent such as carbon is used to make a mold releasing layer 232*c*. One reason for this is that an insulative PFA tube causes electrostatic offset (a phenomenon in which the toner electrostatically adheres to the fixing roller 231) to the fixing roller 231. This is because when an insulative PFA is used, the pressure roller 232 is charged to about −3 to −5 kV due to the frictional charging between the pressure roller 232 and a recording sheet or the fixing roller. As a result, an electrical field arises, so that the pressure roller 232 repels the toner, similarly having negative polarity, at the fixing nip, toward the fixing roller 231. Another reason is that a conductive PFA tube eliminates the need to provide a cleaning device on the side of the fixing roller 231. This is because the addition of an impurity such as a conductive agent to a PFA tube slightly reduces the mold releasing property of the PFA tube itself against the toner. As a result, a cleaning effect can be exerted to the fixing roller 231, whereby the toner and paper dust on the fixing roller 231 are transferred to the side of the pressure roller 232.

As described later, the resistance value (surface resistance) of a PFA tube required to prevent the frictional charging of the pressure roller 232 is $10^7$ Ω/□ or less. According to the present embodiment, a PFA tube with a surface resistance of $10^5$ Ω/□ is used.

The external heating roller 233 has a diameter of 15 mm, and has in its inside a heater lamp 236 serving as a heating source, and is provided on an upstream side with respect to the fixing nip so as to be pressed with a predetermined thrust. Also, a heating nip Z is formed between the external heating roller 233 and the heating roller 232. The external heating roller 233 is constituted of a metal plug 233*a* (hollow cylinder made of aluminum, iron materials, or the like) coated with a heat-resistant mold releasing layer 233*b* made of highly heat-resistant and mold releasing synthetic resins, including elastomers such as silicone rubber and fluorine rubber or fluorine plastics such as PFA and PTFE.

Furthermore, a blend of PFA and PTFE painted and calcinated so as to have a thickness of 25 μm is used as a heat-resistant and mold releasing material to form the mold releasing layer 232*b*.

The cleaning member 247 serves to remove toner and paper dust, and the like adhering to the pressure roller 232 to clean the pressure roller 232. In the present embodiment, a flat scraper is used. The cleaning member 247 can be constituted suitably of a heat-resistant resin sheet or a thin metal plate made of stainless steel, phosphor bronze, and the like further coated with fluorine. In the present embodiment, a phosphor bronze plate with a thickness of 0.1 mm is used.

The purpose of using a scraper as a cleaning member 247 is that it removes the fear of any toner and paper dust being ejected from the cleaning member to the pressure roller. This is because the scraper scrapes toner and paper dust from the pressure roller 232 so as to prevent them from accumulating in the pressure part between the cleaning member and the pressure roller.

In addition, it is preferable that the cleaning member 247 be in contact with the pressure roller in the upstream side with respect to the external heating roller 233. There are two reasons for that. The first reason is that the extent to which the external heating roller 233 is tainted with toner and paper dust is reduced because toner and paper dust are removed in the upstream side (interval between the nip Y in the rotative direction of the pressure roller 232 and the external heating roller 233) of the external heating roller 233. The second reason is that the heating effect of the external heating roller 233 on the surface of the pressure roller 232 is undesirably reduced when the cleaning member 247 is installed in the downstream side (interval between the external heating roller 233 and the nip Y in the rotative direction of the pressure roller 232) of the external heating roller 233. This is because the external heating roller 233 needs to be kept away from the fixing nip in the rotative direction of the pressure roller 232. This is also because the cleaning member 247 installed in the downstream side of the external heating roller 233 takes heat away from the surface of the pressure roller 232. Therefore, according to the present embodiment, as shown in FIG. 1, a scraper serving as a cleaning member 247 is installed in the upstream side of the external heating roller 233.

Disposed on the peripheral surface of the fixing roller 232 and the external heating roller 233 are thermistors 234, 235, and, 236, serving a temperature detection means, which detects the surface temperature of each roller. Also, according to the temperature data detected by each of the thermistors 234, 235, and 236, the temperature controlling means (not shown) controls electricity flowing through the heater lamps 234, 235, and 236 so that the temperature of each roller may be set as predetermined.

Also, a recording material with an unfixed image thereon is carried to the fixing nip at a predetermined fixing speed and printing speed (fixing speed 335 mm/s, printing speed 62 pieces/m, according to the present embodiment) so that the image is fixed with heat and pressure.

In the following, the result of studying the relationship between the electrostatic offset phenomenon and the electrical states (ground: GND or float: FLOAT) of the fixing roller 232 and the pressure roller 232 using the image forming apparatus 1 and the fixing device 23 will be described in detail in reference to Table 1 and FIGS. 11 to 14.

Electrostatic offset was tested by a method in which, with the cleaning member of the fixing device removed, a half-tone image (ID 0.75) of 290 mm (width)×20 mm and a solid image (ID 1.3 or more) were formed and fixed on a top of a recording sheet (hammer mill sheet of LT size) to visually evaluate whether a toner image appears or not after the fixing device 23 has rotated 360 degree (after about 125 mm). As well, the inflow current flowing from the ground into the fixing roller 231 and the pressure roller 232 while the sheet is passing therebetween was measured by using an ampere meter. Specifically, the inflow current flowing into the fixing roller 231 was measured by inserting the ampere meter in series into a line between the ball bearings 81 electrically conducted with the fixing roller and the frame 82 connected to the ground. The inflow current flowing into the pressure roller 232 was measured by putting the ampere meter in series between a conductive brush and the frame 82 with the conductive brush touching the surface of the pressure roller 232.

Table 1 shows the result obtained by studying electrostatic offset in case where the electric polarity of toner and the electric property of a recording sheet are both negative.

It is, for example, when negative toner is developed, by means of reversal development, on a negatively charged OPC (organic photoconductor) photoreceptor, and the toner image is transcribed onto the recording material by using a transcription device according to a corona transcription method with a release charger or a transcription belt method, that toner and recording materials are under the charging condition as described above.

Furthermore, a transcription belt method was used in realizing the transcription device. A surface potential meter showed that the charging potential of the recording sheet was −300 V on the surface (image side) and −500 V on the back.

TABLE 1

Toner: negatively charged, Recording sheet: negatively charged.

| Experiment No. | GND/FLOAT Fixing roller | GND/FLOAT Pressure roller | Inflow current Fixing roller Ih | Inflow current Pressure roller Ip | Offset Fixing roller | Offset Pressure roller |
|---|---|---|---|---|---|---|
| Comparative Example | GND | FLOAT | 0.8 μA | — | X | X |
| Example 1 | FLOAT | FLOAT | — | — | ○ | ○ |
| Example 2 | FLOAT | GND | — | 0.8 μA | ○ | Δ |
| Example 3 | GND | GND | 0.05 μA | 0.75 μA | ○ | Δ |

○: No Offset,
Δ: Offset (allowable level),
X: Offset (unallowable level)

In Comparative Example (fixing roller: ground, pressure roller: float), as shown in Table 1, electrostatic offset occurred with respect to the fixing roller 231. On the contrary, electrostatic offset did not occur with respect to the fixing roller 231 in Example 1 (fixing roller: float, pressure roller: float), Example 2 (fixing roller: ground, pressure roller: ground), and Example 3 (fixing roller: ground, pressure roller: ground).

In addition, whereas electrostatic offset occur with respect to the pressure roller 232 in Comparative Example, the electrostatic offset did not occur at all in Example 1 and so slightly occurred that image problems did not occur in Examples 2 and 3.

The cause of this occurring will be explained in reference to the model drawings shown in FIGS. 11 to 14. Furthermore, each of arrows R shown in the drawings indicates a rotative direction of the roller (=carrier direction of a recording sheet).

COMPARATIVE EXAMPLE

In Comparative Example (FIG. 11), as shown in Table 1, the fixing roller 231 is in a ground state, and the pressure roller 232 is in a float state. In this case, since the recording sheet P is charged to −300 to −500 V, negative charge −Qp retained in the recording sheet P makes the fixing roller 231 electrostatically inductive in a vicinity of the inlet of the fixing nip so that positive charge +Qr and negative charge −Qr are induced into the plug 231*a* of the fixing roller 231.

Since the negative charge −Qp retained in the recording sheet P repels the negative charge −Qr to the ground (current Ia), only the positive charge +Qr remains in the fixing roller 231.

Therefore, the toner Tf (negatively charged) on the image side of the recording sheet P is made electrostatically attractive to the positive charge +Qr in the plug 231*a* of the fixing roller 231 so that the toner Tf partially offsets to the fixing roller 231.

In the fixing nip, the positive charge +Qr in the plug 231*a* of the fixing roller 231 moves toward the recording sheet P to cancel out the negative charge −Qp in the recording sheet P so that the inflow current (Ib=Ia) into the fixing roller 231 is generated.

Meanwhile, the recording sheet P is delivered with its back having a certain amount of toner Tb (positively charged) from the transcription belt. As far as the fixing nip, the toner Tb strongly adheres to the recording sheet P due to the electrostatic attraction of the negative charge ×Qp in the recording sheet P. However, as described above, the toner Tb is affected by the electrostatic repulsion of the positive charge +Qr induced into the fixing roller 231, and lose their electrostatic attractiveness to the recording sheet P since the negative charge −Qp in the recording sheet P is cancelled out in the fixing nip. Therefore, the toner Tb partially offsets to the pressure roller 232 due to a mechanical adhesive force and the like.

EXAMPLE 1

In Example 1 (FIG. 12), as shown in Table 1, the fixing roller 231 and the pressure roller 232 are both in a float state. In this case, as in Comparative Example, negative charge −Qp in the recording sheet P makes the fixing roller 231 electrostatically inductive in a vicinity of the inlet of the fixing nip so that positive charge +Qr and negative charge −Qr are induced into the plug 231*a* of the fixing roller 231.

However, unlike Comparative Example, since the fixing roller 231 is in a float state, the negative charge −Qr that has been induced stays in the plug 231*a* of the fixing roller 231 without being conducted to the ground.

Therefore, since the toner Tf (negatively charged) on the image side of the recording sheet P is made not only electrostatically attractive to the positive charge +Qr but also electrostatically repulsive to the negative charge −Qr in the plug 231*a* of the fixing roller 231, an electrostatic adhesive force (attraction) is much weaker than in Comparative Example, so that the toner Tf does not offset to the fixing roller 231.

Also, in the fixing nip, the positive charge +Qr in the plug 231*a* of the fixing roller 231, electrostatically attractive to the negative charge −Qr, will not move toward the recording sheet P. As a result, the inflow current into the fixing roller 231 does not occur, and the negative charge −Qp is retained without being cancelled out.

Therefore, the toner Tb (positively charged) on the back of the recording sheet P is not affected by the electrostatic repulsion from the fixing roller 231. Also, in the fixing nip, the electrostatic attraction to the negative charge −Qp in the recording sheet P is retained. Therefore, unlike Comparative Example, the toner Tb on the back of the recording sheet P does not offset to the pressure roller 232.

EXAMPLE 2

In Example 2 (FIG. 13), as shown in Table 1, the fixing roller 231 is in a float state, and the pressure roller 232 is in a ground state with its surface in contact with a grounded conductive brush. In this case, as in Example 1, since the fixing roller 231 is in a float state, the negative charge −Qr that has been induced stays in the fixing roller 231 without being conducted to the ground even when the negative charge −Qp in the recording sheet P makes the fixing roller 231 electrostatically inductive. Therefore, the electrostatic adhesive force (attraction), exerted by the toner Tf (negatively charged) on the image side of the recording sheet P, which acts on the fixing roller 231, is extremely weak.

Additionally, the pressure roller 232 has a surface resistance much lower than that of the fixing roller 231 ($10^5$ Ω/□) and is grounded so that the negative charge −Qp retained in the recording sheet P is instantaneously conducted to the ground (Ic) through the pressure roller 232. On this account, the fixing roller 231 will not be made electrostatically inductive. Therefore, there is no toner offsetting to the fixing roller 231.

Meanwhile, although the toner Tb (positively charged) on the back of the recording sheet P strongly adheres to the recording sheet P due to the electrostatic attraction of the negative charge −Qr as far as the fixing nip, the toner Tb loses its electrostatic attractiveness to the recording sheet P since the negative charge −Qp in the recording sheet P is cancelled out in the fixing nip. As a result, the toner Tb slightly offsets to the pressure roller 232 compared with Example 1. However, unlike Comparative Example, since the toner Tb is not affected by the electrostatic repulsion of the positive charge +Qr induced into the fixing roller 231, the toner Tb is much less prone to offset than in Comparative Example, without causing a specific image problem.

EXAMPLE 3

In Example 3 (FIG. 14), as shown in Table 1, the fixing roller 231 and the pressure roller 232 are both in a ground state. In this case, as in Comparative Example, since the fixing roller 231 is in a ground state, there is the possibility of the fixing roller 231 being made electrostatically inductive by the negative charge −Qp in the recording sheet.

However, the pressure roller 232 has a surface resistance much lower than that of the fixing roller 231 ($10^5$ Ω/□) and is grounded so that the negative charge −Qp retained in the recording sheet P is instantaneously conducted to the ground (Ic) through the pressure roller 232. Therefore, the fixing roller 231 will not be made electrostatically inductive so that there is no toner offsetting to the fixing roller 231.

Meanwhile, although the toner Tb (positively charged) on the back of the recording sheet P strongly adheres to the recording sheet P due to the electrostatic attraction of the negative charge −Qp as far as the fixing nip, the toner Tb loses its electrostatic attractiveness to the recording sheet P since the negative charge −Qp in the recording sheet P is cancelled out in the fixing nip. As a result, the toner Tb offsets slightly compared with Example 1. However, unlike Comparative Example, since the toner Tb is not affected by the electrostatic repulsion of the positive charge +Qr induced into the fixing roller 231, the toner Tb is much less prone to offset than in Comparative Example, without causing a specific image problem.

Positively charged toner can be considered exactly as described above and can be treated in the same way, except that the direction of the inflow current into the roller is reversed (that is, from the roller to the ground).

As described above, it is apparent that, when such an arrangement is adopted that the inflow current into the fixing roller 231 is generated (Comparative Example), the effect of electrostatic induction generates electrostatic offset with respect to the fixing roller 231. Meanwhile, when such an arrangement is adopted that the inflow current into the fixing roller 231 is not generated (Examples 1 and 2), the effect of electrostatic induction is lowered to prevent electrostatic offset from occurring with respect to the fixing roller 231.

In addition, even when the inflow current into the fixing roller 231 is generated, the effect of electrostatic induction is similarly restrained to prevent electrostatic offset from occurring with respect to the fixing roller 231 as long as the current is lower than the inflow current into the pressure roller 232 (Example 3).

Additionally, when the inflow current into the fixing roller 231 is 0 or extremely low, the toner on the back of the recording paper can also be restrained from offsetting to the pressure roller 232, compared with the case where the inflow current into the fixing roller 231 is high.

Particularly, it is preferable that the fixing roller 231 and the pressure roller 232 be both in a float state so as to completely prevent offset also on the side of the pressure roller 232 and so as to simplify the arrangement without any electricity removing means, such as a conductive electricity removing brush, on the side of the pressure roller 232.

Figure 15:
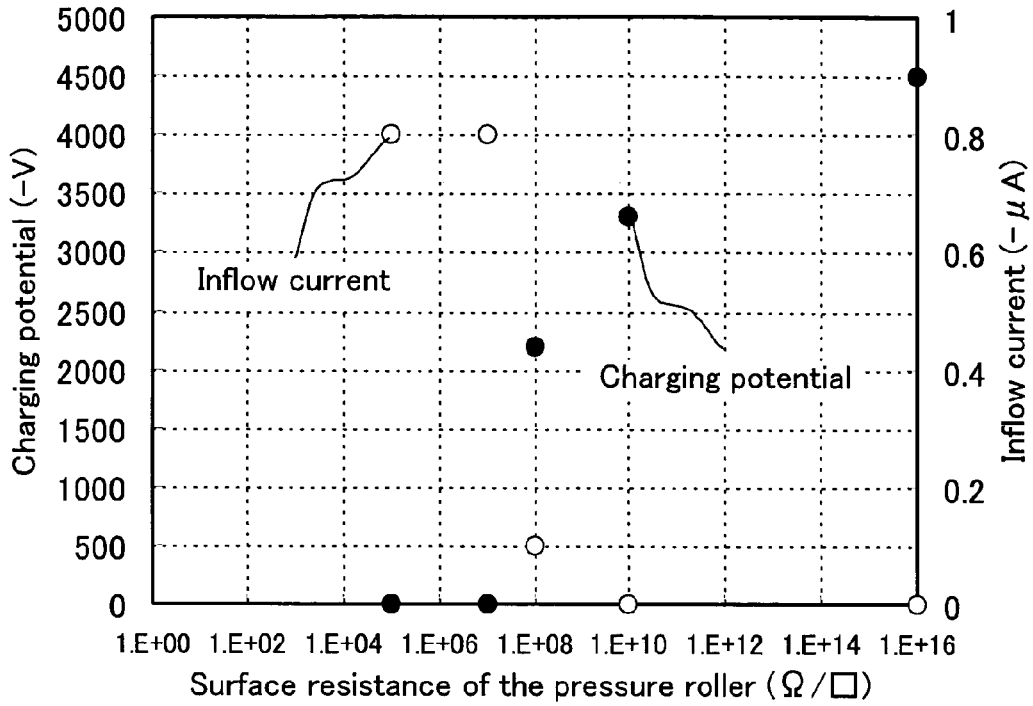
FIG. 15 is a diagram showing a relationship among a surface resistance of a pressure roller, a charging potential of the pressure roller without any electricity removing means, and an inflow current into the pressure roller with the electricity removing means.
Figure 16:
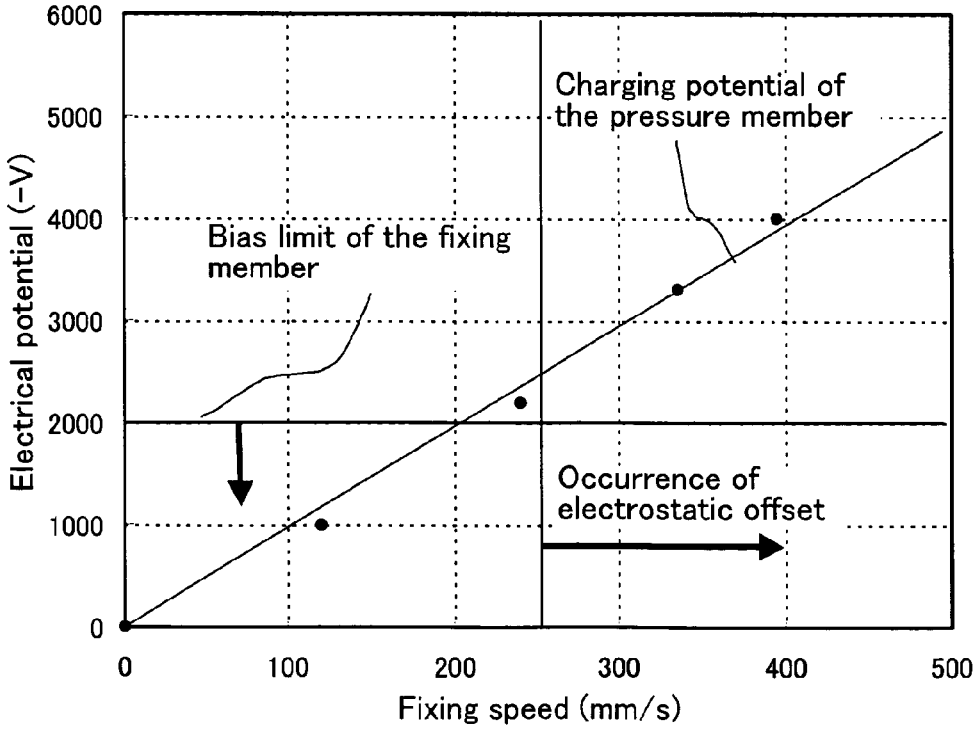
FIG. 16 is a graph showing a relationship between a fixing velocity and a charging potential in the pressure member (pressure roller).

In addition, FIG. 15 shows a relationship among a surface resistance of the pressure roller 232, an electrical potential of the pressure roller 232 without any electricity removing means connected thereto, and an inflow current into the pressure roller 232 with an electricity removing means connected thereto.

FIG. 15 shows that the electrical potential is 0 with the surface resistance of the pressure roller 232 at $10^7$ Ω/□ or lower, and that, with an electricity removing means, the inflow current sufficiently flows from the pressure roller 232 into the recording sheet. On the contrary, FIG. 15 shows that the frictional electrical potential is −3 kV or higher with the surface resistance of the pressure roller 232 at $10^8$ Ω/□ or higher, and that, even with an electricity removing means, there is substantially no inflow current generated. Therefore, it is preferable, according to the present embodiment, that the surface resistance of the pressure roller 232 be set at $10^7$ Ω/□ or lower. Furthermore, the minimum surface resistance is $10^5$ Ω/□ in terms of the manufacturing limit such as material fragility.

In addition, when an electricity removing brush or the like is put in contact with the pressure roller 232 to remove electricity from the pressure roller 232, the electricity removing means is tainted with time, so that it is impossible to stably maintain its electricity removing effect. Accordingly, in the present embodiment, as described above, a conductive scraper is used as cleaning means for the pressure roller 232, and the scraper is grounded, so that the scraper is also used as electricity removing means. As a result, since the scraper scrapes toner and paper dust adhering to the pressure roller 232, the scraper is stably kept in electrical connection to the pressure roller 232, thereby retaining its electricity removing effect.

A fixing device according to the present invention can be used as a fixing device for an electrophotographic apparatus such as a copying machine and a printing machine.

As described above, a fixing device according to the present invention may be arranged so that: the pressure member is conductive and the fixing device further includes a grounding member for grounding the pressure member.

According to the above arrangement, since the pressure member is grounded, most of the electrical charge of a recording material is conducted through the pressure member to the ground. Therefore, the electrical charges of the recording material will not make the fixing device electrostatically inductive, so that the developer is securely prevented from electrostatically offsetting to the fixing device.

The above fixing device may be arranged so that a surface resistance of the pressure member is $10^7$ Ω/□ or less.

According to the above arrangement, since the surface resistance of the pressure member is $10^7$ Ω/□, most of the electrical charge of a recording material is more easily conducted through the pressure member to the ground. Therefore, the developer is more securely prevented from electrostatically offsetting to the fixing device.

The above fixing device may be arranged so that the grounding member has a conductive member in contact with a surface of the pressure member, and the conductive member is also used as a cleaning member for cleaning the pressure member.

According to the above arrangement, the grounding member has a conductive member, which is in contact with the surface of the pressure member, so that the grounding member serves also as a cleaning member for the pressure member. As a result, the arrangement can be simplified.

The above fixing device may be arranged so that the grounding member is a conductive scraper.

According to the above arrangement, since the grounding member is a conductive scraper, the scraper scrapes the developer such as toner and paper dust adhering to the pressure member, so that the scraper is stably kept in electrical connection to the pressure member. This can simplify the arrangement since a grounding member can be used also as a cleaning member without lowering the electricity removing effect on a pressure member.

The above fixing device may be arranged so that the pressure member is electrically insulated from other members in contact with the pressure member.

According to the above arrangement, a fixing member and a pressure member are both in a float state, so that the electrical charge of a recording material is retained. This can prevent the developer, adhering to the back side of the recording material, which has polarity adverse to that of the developer, from adhering to the side of the pressure member. Therefore, this lightens the burden imposed on a cleaning member installed on the side of the pressure member, so that the fixing capacity can be maintained stably over an extended period of time.

The above fixing device may be arranged so that a fixing speed is 250 mm/s or higher.

When the fixing speed is 250 mm/s, the friction-charged potential of a pressure member reaches as high as −3 to −5 kV. Meanwhile, there has been a conventional technique by which a bias is applied to a fixing member to prevent electrostatic offset. In this technique, however, a bias voltage of only up to about −2 kV can be applied to a fixing device. This is due to the low pressure-resistant capacity of the coating layer (usually of fluorine plastics) of the fixing device. As a result, the Coulomb force toward the fixing member acts on the toner (usually negatively charged) on a recording material so that there still occurs electrostatic offset.

On the contrary, the above fixing devices according to the present invention are not limited by the fixing speed. Therefore, in such devices for high-speed machines, electrostatic offset can be effectively prevented.

An image forming apparatus according to the present invention is so arranged as to have one of the above fixing devices.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A fixing device, comprising:

a fixing member in contact with an unfixed image constituted of developer on one side of a recording material; and a pressure member pressed against the fixing member, the fixing device fixing the unfixed image onto the recording material by causing the recording material, charged so as to have a same polarity as a polarity of the developer, to pass through a gap between the fixing member and the pressure member, wherein when the recording material passes through the gap between the fixing member and the pressure member, an inflow current into the fixing member Ih is 0, wherein the fixing member is kept in an electrically float state while fixing the unfixed image onto the recording material, wherein the pressure member is conductive, the fixing device further includes grounding means for grounding the pressure member, and wherein the grounding means has a conductive member in contact with a surface of the pressure member, and the conductive member is used also as cleaning means for cleaning the pressure member.

2. The fixing device according to claim 1, wherein the grounding means is a conductive scraper.

3. A fixing device, comprising:

a fixing member in contact with an unfixed image constituted of developer on one side of a recording material; and a pressure member pressed against the fixing member, the fixing device fixing the unfixed image onto the recording material by causing the recording material, charged so as to have a same polarity as a polarity of the developer, to pass through a gap between the fixing member and the pressure member, wherein when the recording material passes through the gap between the fixing member and the pressure member, $Ih<Ip$ where an inflow current into the fixing member is Ih and an inflow current into the pressure roller is Ip, wherein a surface resistance of the pressure member is smaller than a surface resistance of the fixing member, wherein the pressure member is conductive, the fixing device further includes grounding means for grounding the pressure member, and wherein the grounding means has a conductive member in contact with a surface of the pressure member, and the conductive member is used also as cleaning means for cleaning the pressure member.

4. The fixing device according to claim 3, wherein the grounding means is a conductive scraper.

5. A fixing device, comprising:

a fixing member in contact with an unfixed image constituted of developer on one side of a recording material; and a pressure member pressed against the fixing member, the fixing device fixing the unfixed image onto the recording material by causing the recording material, charged so as to have a same polarity as a polarity of the developer, to pass through a gap between the fixing member and the pressure member, wherein the fixing member is electrically insulated from other members in contact with the fixing member, wherein the pressure member is conductive, the fixing device further includes grounding means for grounding the pressure member, the grounding means has a conductive member in contact with a surface of the pressure member, and the conductive member is used also as cleaning means for cleaning the pressure member.

6. The fixing device according to claim 5, wherein the grounding means is a conductive scraper.

7. The fixing device according to claim 6, wherein the pressure member is formed in a roller shape, and a bearing provided on an axis portion of the pressure member is attached to a frame of the fixing device through an insulating member.

* * * * *